US005704560A

United States Patent [19]

Wimmer

[11] Patent Number: 5,704,560

[45] Date of Patent: Jan. 6, 1998

[54] CONCRETE CRUSHER WITH CUTTING SHEARS

[75] Inventor: Alois Wimmer, Hof B. Salzburg, Austria

[73] Assignee: Wimmer Hartstahl GesmbH & Co. KG, Thalgau, Austria

[21] Appl. No.: 677,133

[22] Filed: Jul. 9, 1996

[51] Int. Cl.[6] ..... B02C 1/02; B02C 1/10

[52] U.S. Cl. ..... 241/266; 241/101.73; 241/264; 30/134

[58] Field of Search ..... 241/101.73, 101.01, 241/266, 262, 264; 30/134

[56] References Cited

U.S. PATENT DOCUMENTS

| | | | |
|---|---|---|---|
| 2,044,624 | 6/1936 | Morgan | 214/138 |
| 3,872,528 | 3/1975 | Porter | 30/134 X |
| 4,104,792 | 8/1978 | LaBounty | 30/134 |
| 4,188,721 | 2/1980 | Ramun et al. | 30/134 |
| 4,196,862 | 4/1980 | Tagawa | 241/266 |
| 4,512,524 | 4/1985 | Shigemizu | 241/101.7 |
| 4,549,349 | 10/1985 | Harrison | 30/134 X |
| 4,719,975 | 1/1988 | LaBounty | 173/46 |
| 4,771,540 | 9/1988 | LaBounty | 30/134 |
| 4,776,524 | 10/1988 | Sakato | 241/101.7 |
| 4,838,493 | 6/1989 | LaBounty | 241/101.7 |
| 4,934,616 | 6/1990 | Zepf | 241/101.73 X |
| 4,951,886 | 8/1990 | Berto | 241/101.7 |
| 4,955,961 | 9/1990 | Tagawa | 241/101.73 X |
| 5,187,868 | 2/1993 | Hall | 30/134 |
| 5,230,151 | 7/1993 | Kunzman et al. | 30/134 |
| 5,375,329 | 12/1994 | Morikawa et al. | 241/101.73 X |
| 5,384,962 | 1/1995 | Pemberton | 30/134 |
| 5,478,019 | 12/1995 | Morikawa et al. | 241/101.73 |
| 5,533,682 | 7/1996 | De Gier et al. | 241/101.73 |

FOREIGN PATENT DOCUMENTS

| | | | |
|---|---|---|---|
| 0362098 | 4/1990 | European Pat. Off. . | |
| 280 350 | 7/1990 | German Dem. Rep. | 241/266 |
| 42 09 278 | 9/1993 | Germany | 241/266 |

*Primary Examiner*—Daniel W. Howell
*Assistant Examiner*—Julie A. Krolikowski
*Attorney, Agent, or Firm*—Herbert L. Lerner; Laurence A. Greenberg; Werner H. Stemer

[57] ABSTRACT

A concrete crusher has cutting shears with a first cutting arm forming an additional arm on one of the jaws of the breaker tongs and a second cutting arm rigidly joined to the frame of the concrete crusher. An hydraulic piston/cylinder unit drives the jaws such that the first cutting arm is in an open position relative to the second cutting arm when the jaws are in an open position.

4 Claims, 3 Drawing Sheets

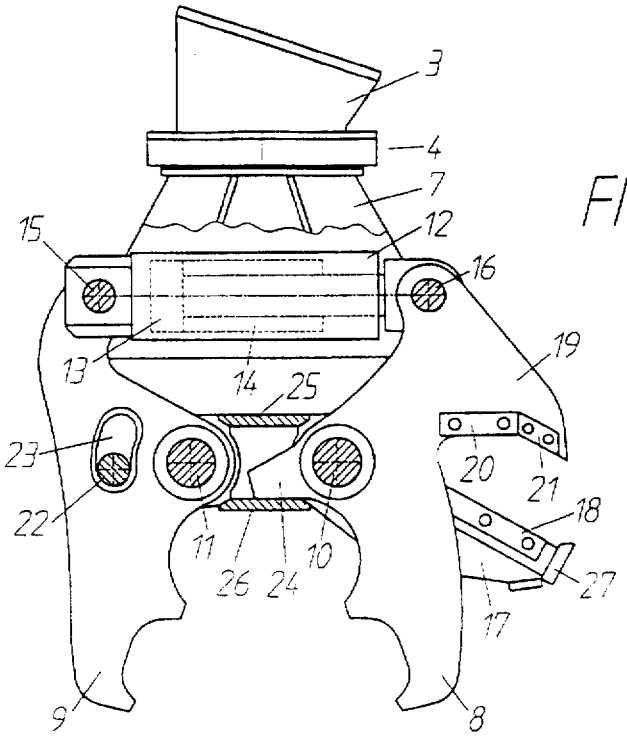
FIG. 3
FIG. 5
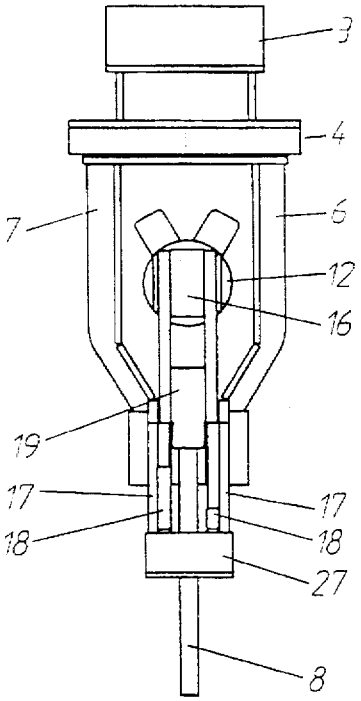
FIG. 4
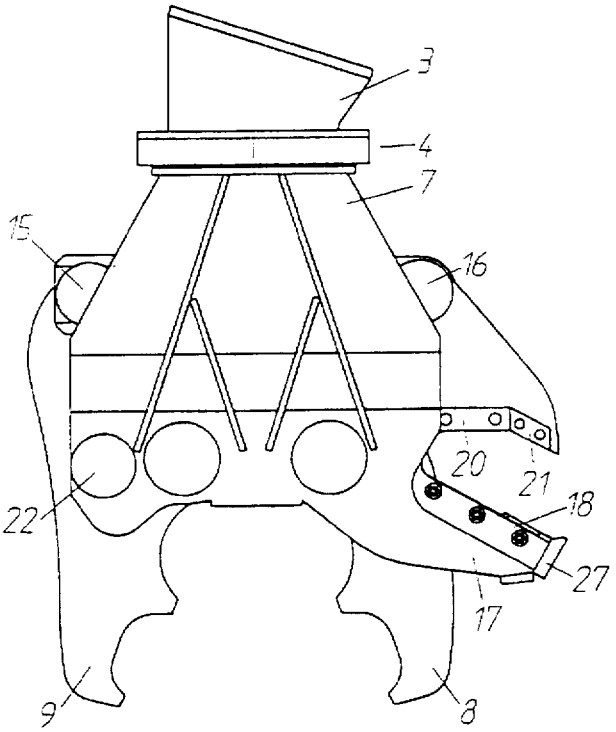

CONCRETE CRUSHER WITH CUTTING SHEARS

BACKGROUND OF THE INVENTION

1. Field of the Invention

The invention relates to concrete crushers with cutting shears and with a frame rotatably mounted on an excavator receptacle; the jaws forming the concrete crusher, i.e., the breaker tongs, are pivotably articulated on the frame and they are drivable by means of a hydraulic piston/cylinder unit; one cutting arm of the shears is rigidly joined to one of the jaws, and the second cutting arm of the shears is rigidly mounted on the frame.

2. Description of the Related Art

A concrete crusher of the foregoing type is disclosed in U.S. Pat. No. 4,951,886 to Michel Berto. One cutting arm of the shears is formed by a blade on the backside of the associated jaw of the concrete breaker tongs. The second arm of the shears is formed by an arm rigidly disposed on the frame, which is located on the side of the jaw toward the jaw blade. When the concrete breaker tongs move into their closing position, as is the case for breaking concrete, for instance, then the shears open. Conversely, on opening the concrete breaker tongs, the shears are closed. This means the hydraulic piston/cylinder unit must be acted upon in the direction opposite the direction for breaking concrete for the purpose of opening the shears.

In that concrete crusher it is necessary, for breaking concrete, to act upon the hydraulic piston/cylinder unit on the side of the piston opposite the piston rod, while conversely, for cutting the reinforcement with the shears, to act upon the hydraulic piston/cylinder unit on the side of the piston that has the piston rod. This has the disadvantage that only reduced forces can be brought to bear in the cutting motion, because of the smaller piston area available, and furthermore at high cutting resistance very high pressures occur in the piston/cylinder unit, which severely strain the seal between the piston rod and the cylinder bottom.

Similar types of concrete crushers are disclosed in U.S. Pat. Nos. 4,196,862 to Tagawa; 4,776,524 to Sakato; 4,719,975 and 4,838,493 to LaBounty; and 4,512,524 to Shigemizu.

SUMMARY OF THE INVENTION

It is accordingly an object of the invention to provide a concrete crusher with cutting shears, which overcomes the above-mentioned disadvantages of the prior art devices and methods of this general type and which enables the application of maximum crushing and cutting forces for each operation, while placing the least possible strain on the hydraulic system.

With the foregoing and other objects in view there is provided, in accordance with the invention, a concrete crusher with cutting shears, comprising:

a frame rotatably mountable on an excavator boom receptacle;

jaws defining concrete breaker tongs pivotally mounted on the frame;

an hydraulic piston/cylinder unit drivably connected to the jaws;

a first cutting arm of the cutting shears rigidly joined to one of the jaws, and a second cutting arm of the cutting shears rigidly joined to the frame;

the first cutting arm being disposed as an additional arm on one of the jaws of the concrete breaker tongs such that, when the first cutting arm is in an open position relative to the second cutting arm, the breaker tongs are in an open position as well.

In other words, the above-mentioned objects are satisfied in that the movable cutting arm of the shears is disposed as an additional arm on the associated jaw of the concrete crusher (the breaker tongs). Further, the movable cutting arm is located in the open position of the shears when the breaker tongs are in the open position. As a result it is possible to handle both operating motions via the cylinder chamber remote from the piston rod, and therefore a high operating pressure is attainable in the cutting motion as well, without excessively straining the seal provided by externally sealing parts.

In accordance with an added feature of the invention, the first cutting arm of the cutting shears is integrally formed with the one jaw of the concrete breaker tongs.

In accordance with a concomitant feature of the invention, the first and second cutting arms define an opening of the cutting shears, the opening being oriented approximately transversely to an opening of the breaker tongs.

Advantageously, the movable cutting arm of the shears are integrally formed with the associated jaw of the concrete breaker tongs. As a result, a very sturdy crusher is provided which is essentially invulnerable to malfunction. When the opening of the shears is oriented approximately transversely to the opening of the crusher tongs, the tongs hinder neither the gripping nor the cutting motion when the shears are pivoted in the working direction The same is also true for the concrete breaker tongs with respect to the cutting shears, since in the operating position of the concrete breaker tongs, the cutting shears are pivoted out of operating range.

Other features which are considered as characteristic for the invention are set forth in the appended claims.

Although the invention is illustrated and described herein as embodied in a concrete crusher with cutting shears, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWING

FIG. 3 is a rear elevational view thereof with the upper part of the frame removed;

FIG. 4 is a view similar to FIG. 3 but with the frame closed;

FIG. 5 is an end view of the embodiment of FIG. 4;

DESCRIPTION OF THE PREFERRED EMBODIMENTS

Figure 1:
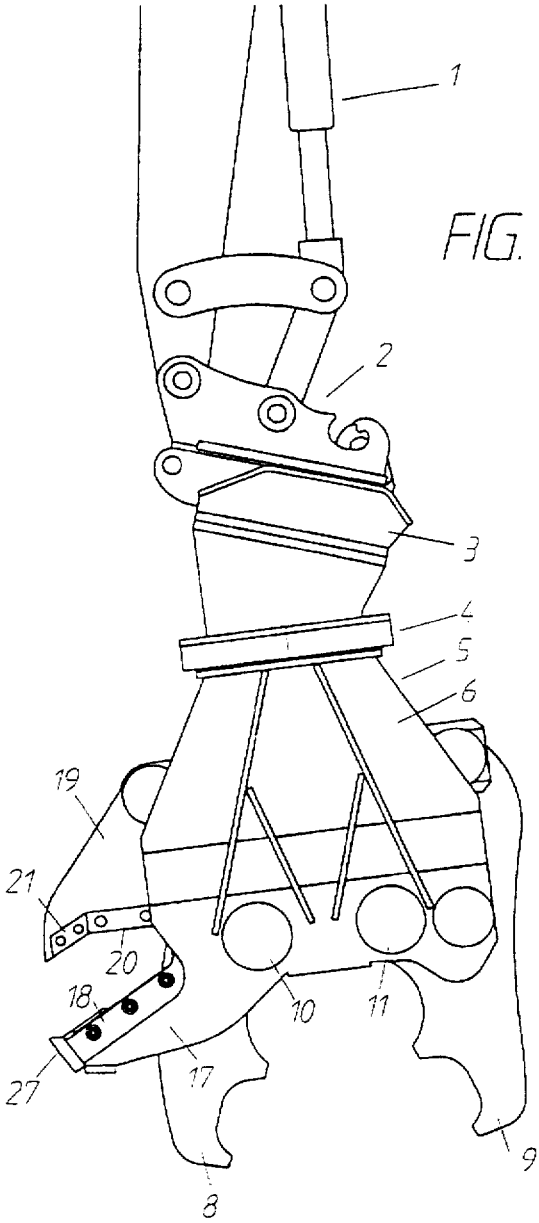
FIG. 1 is an front elevational view of a first embodiment, including a partial illustration of an excavator boom.
Figure 2:
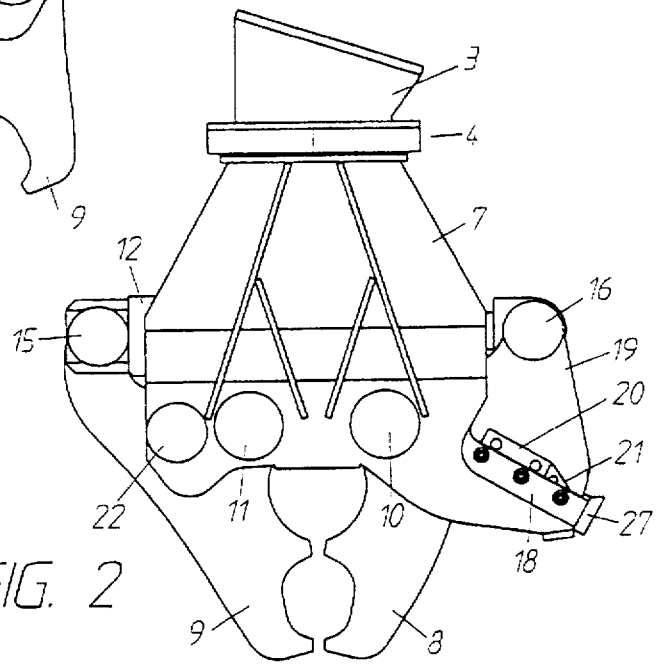
FIG. 2 is a rear elevationai view of the first embodiment in the closed position of the breaker jaws and shears, with the excavator boom and the upper part of the connecting not illustrated for clarity.

Referring now to the figures of the drawing in detail and first, particularly, to FIG. 1 thereof, there is seen a first exemplary embodiment of the invention with an excavator boom 1 (also referred to as a jib). A coupling body 3 is mounted on the boom 1, via a coupling 2. The coupling body 3, at its distal end from the coupling 2, has a pivot joint 4 through which the coupling body 3 carries a frame 5 for the concrete breaker tongs with cutting shears of the invention. The pivot joint allows the concrete breaker tongs with the cutting shears to be rotated relative to the excavator boom.

The frame 5 has a front cover plate 6 and a rear cover plate 7, between which breaker jaws 8 and 9 for breaking concrete are supported via pivot shafts 10 and 11, respectively. The two breaker jaws 8 and 9 are pivotable toward one another via an hydraulic piston/cylinder unit 12, 13, 14. The hydraulic piston/cylinder unit engages the jaws 8 and 9 through pivot bolts 15 and 16. The jaws 8, 9 thus form two-armed levers, the front side of which serves the purpose of concrete crushing and engages the hydraulic piston/cylinder unit 12, 13, 14 on the other end via the aforementioned pivot bolts 15, 16.

A cutting arm 17 is rigidly mounted on the frame 5, in the present case on the rear cover plate 7. The cutting arm 17 carries a blade 18 that cooperates with blades 20, 21 provided on the second cutting arm 19 to cut metal reinforcements (rebars and the like) found in reinforced concrete structures. The second cutting arm 19 in this case is integrally formed with the jaw 8 of the concrete crusher. It should be understood that, naturally, the cutting arm 19 could be a separate component mounted by conventional connecting means.

The blades 20 and 21 form an obtuse angle with one another, specifically in such a way that the opening angle of the blade 21 approaching the tip of the cutting arm 19 is smaller than that of the blade 20. As a result, when metal reinforcements are cut the material is prevented from slipping out of the shears. For the same purpose, and also for receiving the material more easily, a receptacle 27 for cutting material is provided on the outermost end of the cutting arm 17, on the outer end of the blade 18. The receptacle 27 projects beyond the cutting arm 17 toward the other cutting arm 19, and the frontmost edge of the receptacle 27 is joined toward the blade 18 via an inclined face which, when the shears close, deflects cutting material, resting on the front end of the receptacle 27, toward the rear.

The motions of the jaws 8, 9 are controlled via stops; one of the jaws is formed with an oblong hole 23 (a circularly arcuate hole 23), that is penetrated by a stop bolt 22. The ends of the oblong hole limit the motion of the jaw 9. The jaw 8 conversely has a stop lug 24, which in the opened state rests on a stop 26 and in the closed state on a stop 25. The stop limitation of the jaws 8, 9 is provided because the hydraulic piston/cylinder unit 12, 13, 14 is freely suspended between the two jaws, so that the effect of the stops is that both in the open position and the closed position, the jaws 8, 9 are always located in the same position relative to one another.

The movement of the cutting arm 19, which is formed integrally with the jaw 8, is also controlled via the stop lug 24 and the stops 25, 26. Accordingly, the stop also determines the various positions of the cutting shears.

With reference to FIG. 3, the pressure introduction for closing the jaws 8, 9 and thus also for closing the shears 17, 19 is effected such that the chamber of the cylinder 12 located before the piston 13, that is, the cylinder chamber opposite the piston rod 14, is acted upon by pressure. It is thus accomplished that in the closing motion of not only the jaws 8, 9 of the concrete crusher but also the cutting arms 17, 19 of the cutting shears, the entire piston surface area is acted upon by pressure, so that higher cutting forces can be brought to bear. The cylinder chamber located behind the piston 13 and penetrated by the piston rod 24 is acted upon by pressure only for the opening motion, that is, for a motion in which no noteworthy counterpressure or virtually no counterpressure occurs, so that the lesser piston area available is readily sufficient for imposing pressure, and moreover the leadthrough of the piston rod 14 through the bottom of the cylinder 12 is stressed only by the lower pressure necessary for the opening motion.

In the variant embodiment of FIGS. 1–5, the opening of the cutting shears points approximately transversely to the opening of the breaker tongs laterally of the breaker tongs. With particular reference to FIG. 5, the cutting shears are located in the same plane as the breaker tongs. Such an embodiment has the advantage that whichever tool is not in use at a given time protrudes laterally away from the tool that is in use, so that two tools can be used without affecting or hindering one another.

Figure 6:
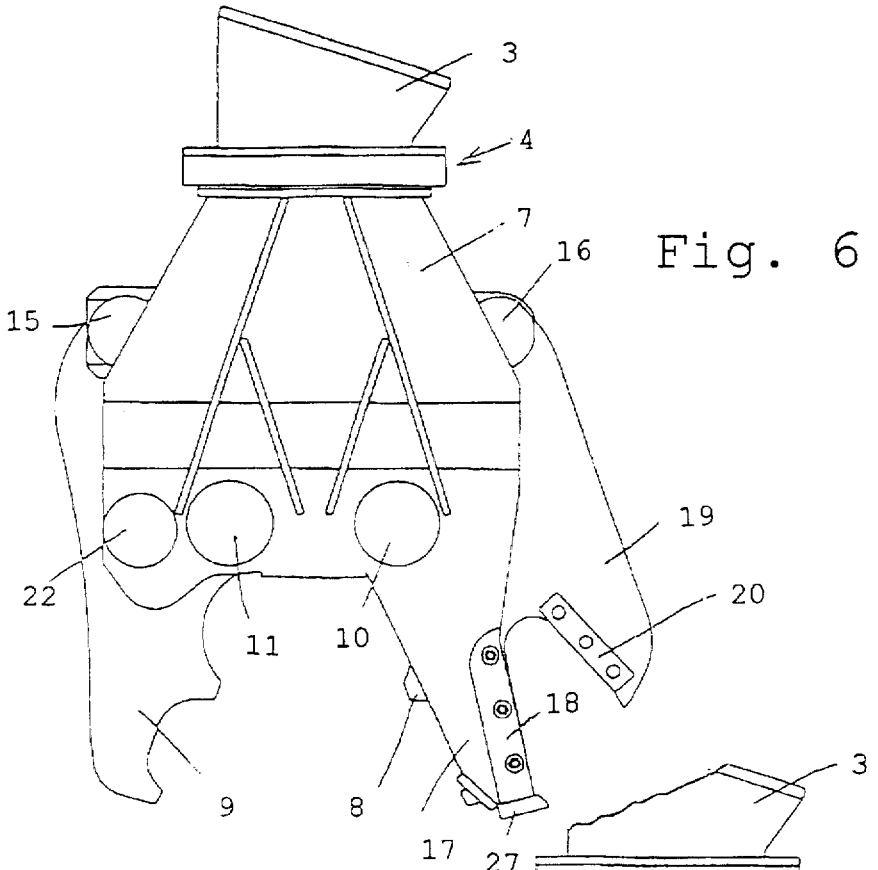
FIG. 6 is a view similar to FIG. 4 of a second embodiment.
Figure 7:
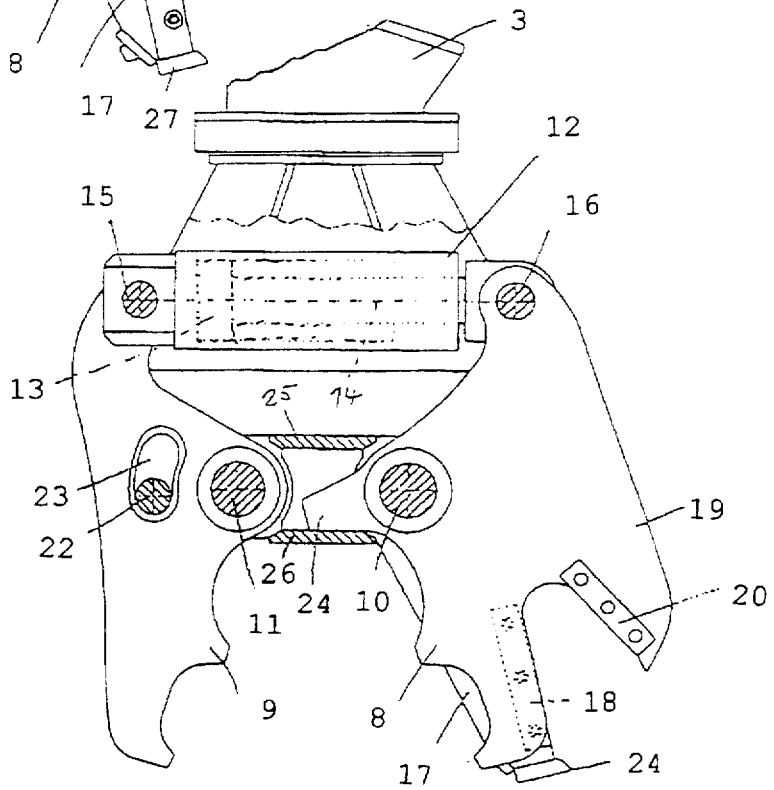
FIG. 7 is a view similar to FIG. 6 with the front plate of the frame removed.

In the variant embodiment of FIGS. 6 and 7, the opening of the cutting shears points laterally away from the opening of the breaker tongs by only a small acute angle. The two tools are located in the same plane, side by side. Such an embodiment makes it possible to work without major swiveling in the region of the coupling 2 between the excavator arm 1 and the coupling body 3. The one slight disadvantage is that, when the crusher of the invention is used in working on the ground, work-related material lying around can hinder the use of one tool or the other. In both these FIGS. 6 and 7, the operative components that are the same as in the embodiment of FIGS. 1–5 are identified by the same reference numerals, except that the reference numerals have been changed for the modified parts only, namely for the cutter arms to 17' and 19' and for the blades to 18' and 20'.

The mode of operation with regard to piston/cylinder unit and the advantageous force introduction is the same, in the embodiment of FIGS. 6 and 7, as in the embodiment of FIGS. 1–5.

I claim:

1. A concrete crusher with cutting shears, comprising:

a frame rotatably mountable on an excavator boom receptacle;

jaws defining concrete breaker tongs pivotally mounted on said frame;

an hydraulic piston/cylinder unit drivably connected to said jaws;

a first cutting arm of the cutting shears distinct from and rigidly joined to one of said jaws, and a second cutting arm of the cutting shears rigidly joined to said frame;

said first cutting arm being disposed as an additional arm on one of said jaws of said concrete breaker tongs such that, when said first cutting arm is in an open position relative to said second cutting arm, said breaker tongs are in an open position as well.

2. The concrete crusher according to claim 1, wherein said first cutting arm of the cutting shears is integrally formed with said one jaw of the concrete breaker tongs.

3. The concrete crusher according to claim 1, wherein said first and second cutting arms define an opening of the cutting shears, the opening being oriented approximately transversely to an opening of the breaker tongs.

4. A concrete crusher assembly, comprising:

a frame to be mounted on an excavator boom receptacle;

a concrete crusher formed by two jaws pivotally mounted on said frame;

an hydraulic piston/cylinder unit attached to said jaws for pivoting said jaws;

cutting shears formed by a first cutting arm distinct from and rigidly joined to one of said jaws, and by a second cutting arm rigidly joined to said frame;

whereby said cutting shears are in an open position when said jaws of said concrete crusher are in an open position, and said cutting shears are closed when said jaws of said concrete crusher are closed.

* * * * *